US005676056A

United States Patent [19]

Stein et al.

[11] Patent Number: 5,676,056

[45] Date of Patent: Oct. 14, 1997

[54] ROTARY PRINTING PRESS WITH A FREELY MOUNTABLE FOLDER

[75] Inventors: Götz Stein, Bolligen; Hans Ulrich Siegenthaler, Brenzikofen, both of Switzerland

[73] Assignee: Maschinenfabrik WIFAG, Bern, Switzerland

[21] Appl. No.: 642,465

[22] Filed: May 3, 1996

[30] Foreign Application Priority Data

May 4, 1995 [DE] Germany ..... 195 16 445.8

[51] Int. Cl.[6] ..... B05C 17/06

[52] U.S. Cl. ..... 101/226; 101/248; 493/359; 493/405; 493/410; 270/6; 270/21.1

[58] Field of Search ..... 101/216, 219, 101/224, 225, 226, 227, 228, 248; 493/405, 411, 416, 442, 356, 361, 362, 359, 357, 424, 324; 270/52.5, 6, 21.1

[56] References Cited

U.S. PATENT DOCUMENTS

| | | | |
|---|---|---|---|
| 3,784,187 | 1/1974 | Takayanagi et al. | 270/6 |
| 4,176,833 | 12/1979 | Heimlicher | 101/226 |
| 4,279,410 | 7/1981 | Bolza-Schünemann | 270/6 |
| 4,564,470 | 1/1986 | Schmitt | 270/21.1 |
| 4,611,799 | 9/1986 | Nuttin | 270/52.5 |
| 4,861,326 | 8/1989 | Kühner et al. | 493/359 |
| 5,042,788 | 8/1991 | Bowman et al. | 101/226 |
| 5,242,367 | 9/1993 | Marmin | 493/359 |
| 5,405,127 | 4/1995 | Wezborn | 270/21.1 |
| 5,429,579 | 7/1995 | Nishihara | 493/359 |
| 5,542,350 | 8/1996 | Theilacker et al. | 101/226 |

*Primary Examiner*—Eugene H. Eickholt

*Attorney, Agent, or Firm*—McGlew and Tuttle

[57] ABSTRACT

In a rotary printing press with at least one folder, which comprises at least one cutting cylinder and one folding jaw cylinder, each folder is driven, due to being equipped with at least one separate drive motor, mechanically independently at least from the printing units of the printing press, and can be installed and registered independently therefrom.

16 Claims, 6 Drawing Sheets

ROTARY PRINTING PRESS WITH A FREELY MOUNTABLE FOLDER

FIELD OF THE INVENTION

The present invention pertains to a rotary printing press with a folder including a cutting cylinder and a folding jaw cylinder.

BACKGROUND OF THE INVENTION

A folder is, or many folders are, driven and synchronized by a main drive via a longitudinal shaft in prior-art rotary printing presses. A plurality of printing units and one folder are usually installed in one line. This is the least expensive drive for the longitudinal shaft design. Additional folders, even if they are only back-up folders, are mounted integrated in the overall shop.

One example of a prior-art drive, e.g., one according to DE 41 27 321 A1, is schematically shown in FIG. 1. The longitudinal shaft 1.10 is coupled here mechanically with the folder, comprising a cutting cylinder 2, a collecting cylinder 3, and a folding jaw cylinder 4, via a longitudinal shaft gearbox 1, various toothed steps 1.20, and a shaft 1.23 to an intermediate gear 1.3 coupled with a bevel gear 1.24 or, as an alternative, to the cutting cylinder 2 coupled with a bevel gear 1.24. The cylinders 2, 3 and 4 are mechanically coupled with one another via spur gears. It is disadvantageous here that the cylinders 2, 3 and 4 may assume any desired position in relation to one another and in relation to the longitudinal shaft 1.10 in the area of the backlash. This is due to the torques acting on the cylinders, such as cam controls, cutting shock, etc. Irregularities, which are not avoidable as a result, become noticeable in the folding tolerances.

SUMMARY AND OBJECTS OF THE INVENTION

The object of the present invention is to increase the flexibility in terms of the possible configurations of a rotary printing press in terms of cutting, folding, and delivery.

The setting of the register shall preferably also be performed individually for the folder while at the same time preventing or at least reducing the folding inaccuracies due to the backlash of the gears in the drive line of the folder.

According to the present invention, a folder of a rotary printing press with at least one folding jaw cylinder and a cutting cylinder, preferably also with a collecting cylinder and a delivery means has a drive motor, which is mechanically coupled with the folder only, for individually driving the folder.

Due to no longer needing the mechanical coupling with the printing units, the free arrangement or mounting of the folder in relation to the printing units, and advantageously also in relation to a folding structure and a folding superstructure, is possible without causing any additional costs.

Since preferably there is no mechanical connection between the folder and the folding structure or the folding superstructure, flexibility is also increased with regard to the configuration of these three assembly units. It is possible, e.g., to assign only one structure and one superstructure to two folders.

Problems due to the backlash of teeth are eliminated, while the drive motor for the folder is electrically synchronized for driving with the other components of the printing press. The individual drive makes it possible to rotate the folder into any desired folding position regardless of the position of the printing units and to reach the crop mark in a simple manner as a result. This advantage is especially useful in the case of paper feed into a back-up folder, because the crop mark can be reached in such a back-up folder via a null position of the drive, which is used as a reference. The folding tolerances are minimized by the present invention.

If a first folder and a second folder are provided, the following arrangement variants are preferred:

Both folders may be placed in the shop plane, especially as a left folder design and as a right folder design in a so-called back-to-back arrangement or as a double folder with delivery to the same side of the press. The first possibility can be built as an especially narrow unit with correspondingly short transfer paths for the web. The second variant, i.e., the double folder, offers the advantage that both delivery units are located on one side of the press and two identical folders can be used. Both arrangement variants make possible operation in one plane.

It is also possible to place a first folder in the shop plane, while a second folder is located, offset in relation to it, in the press cellar. This leads to short web transfer paths and to unhindered access to the folders.

If a folding structure and a folding superstructure are mounted on the press table, i.e., in the shop plane, a small overall height is obtained.

Finally, it is also possible to install both folders in the cellar, namely, as a double folder with separate structure mounted on the press table, or as a double folder in a common, attached structure. Due to the arrangement in the reel changer plane, both variants are characterized by a low overall height above the plane of the press. They can also be operated especially easily, because they are arranged in one plane.

Only one structure and one superstructure are advantageously provided for a plurality of folders in all the above-mentioned exemplary embodiments.

In another embodiment of the present invention, which can be advantageously combined with the above-mentioned exemplary embodiments, the folder itself is designed as a traveling folder. If the folding structure and the folding superstructure are placed on a yoke, a back-up folder, if one is provided, may be pushed in if needed instead of the main folder. Depending on the displacement method used, no additional space is needed now in the shop. If the press table itself is used as a yoke construction, and the folders are placed in the cellar, a small overall height is also achieved as a result.

The folding structure and the folding superstructure may, in principle, also be arranged as traveling units on a yoke construction.

The present invention can be especially advantageously combined with the drive and control design disclosed in EP 0 644 048 A2, whose teaching is thus included.

In a preferred embodiment, a drive motor drives a folding jaw cylinder via a mechanical coupling, preferably a motor-side pinion and a cylinder-side spur gear. It is thus possible to obtain high transmission ratios in one step in a space-saving manner. The costs are reduced due to the elimination of a longitudinal shaft gearbox and all drive components, such as shafts and gears, including an intermediate gear. Due to its relatively high inertia of mass and low operating torques, the drive is coupled in this design variant at an especially quiet point of the folder. The pulling of the web at the collecting cylinder, the friction torques of the cylinder bearings, the draw rollers in the folder, and the cutting shock generate a torque, which counteracts the driving motor. A flank change by the control of the drive motor in the drive from the motor-side pinion to the cylinder-side spur gear and between the cylinder spur gears of the cylinders of the folder can be prevented from occurring as a result. Another advantage is the fact that due to the arrangement of the drive on the folding jaw cylinders and to the tooth contact being always on the same side, a change between driving and braking motor operation is prevented, and the motor runs in the driving range only. Such a change in operation could easily lead to damage to the drive of the folder. When pulsed operating torques occur, which may lead to disturbing flank changes in the drive, it is sufficient to always maintain the tooth contact especially between the pinion and the spur gear on the same side by an additional torque to the folding jaw cylinder. Such a torque is relatively small compared with the driving torque and can be introduced by, e.g., an electric brake or a friction brake.

In a likewise preferred embodiment, the motor-side pinion meshes with any other gear arranged downstream of the cutting cylinder in the drive line of the cylinders of the folder.

In another variant, the drive motor is arranged where the longitudinal shaft gearbox is located according to the state of the art.

In another preferred design variant, the drive motor drives the cutting cylinder via a toothed belt. The weight of the cutting cylinder can now be added to the low own weight of the drive motor, as a result of which the control dynamics can be improved. A transmission between the drive motor and the cutting cylinder in more than one stage may now also be provided.

Driving from the motor to the collecting cylinder via a toothed belt is also preferred. The weight of the collecting cylinder, which is greater than that of the cutting cylinder, can now also be added to the low own weight of the drive motor, which improves the control dynamics, as was mentioned above. A multistep transmission between the drive motor and the collecting cylinder may be preferred in this case as well.

Finally, the folding jaw cylinder may also be driven via such a toothed belt.

In another preferred embodiment of the present invention, the drive motor drives any desired gear in the entire drive line between the cutting cylinder and the delivery means, e.g., a spider wheel, via a toothed belt. It is also possible in this case to drive an intermediate gear that is in functional connection with the drive line. The necessary transmission ratio from the drive motor to the gear is advantageously achieved in one step, so that a space-saving solution is again obtained.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
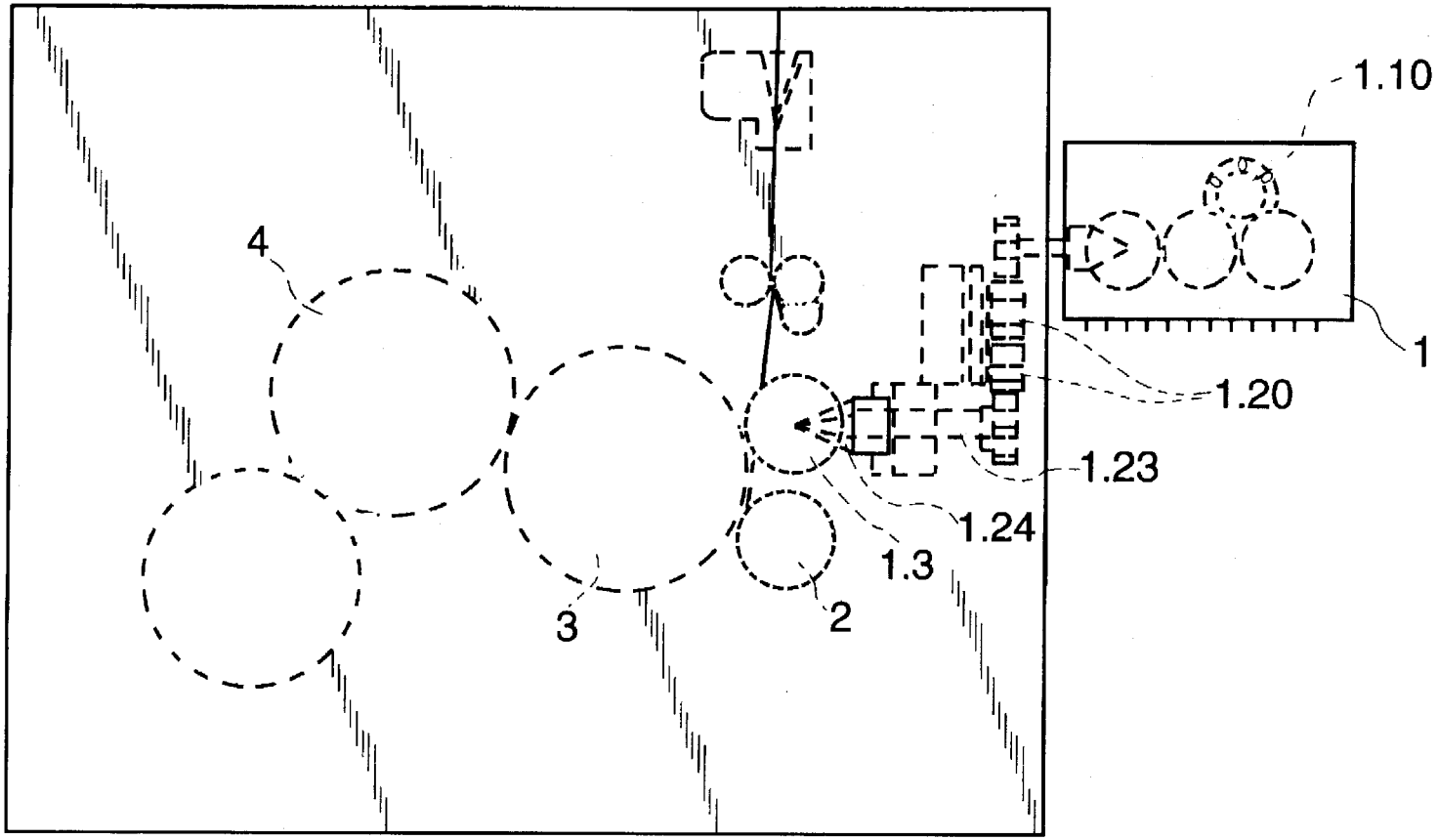
Fig. 1 (PRIOR ART)
FIG. 1 is an individually driven folder of the prior art.
Figure 2:
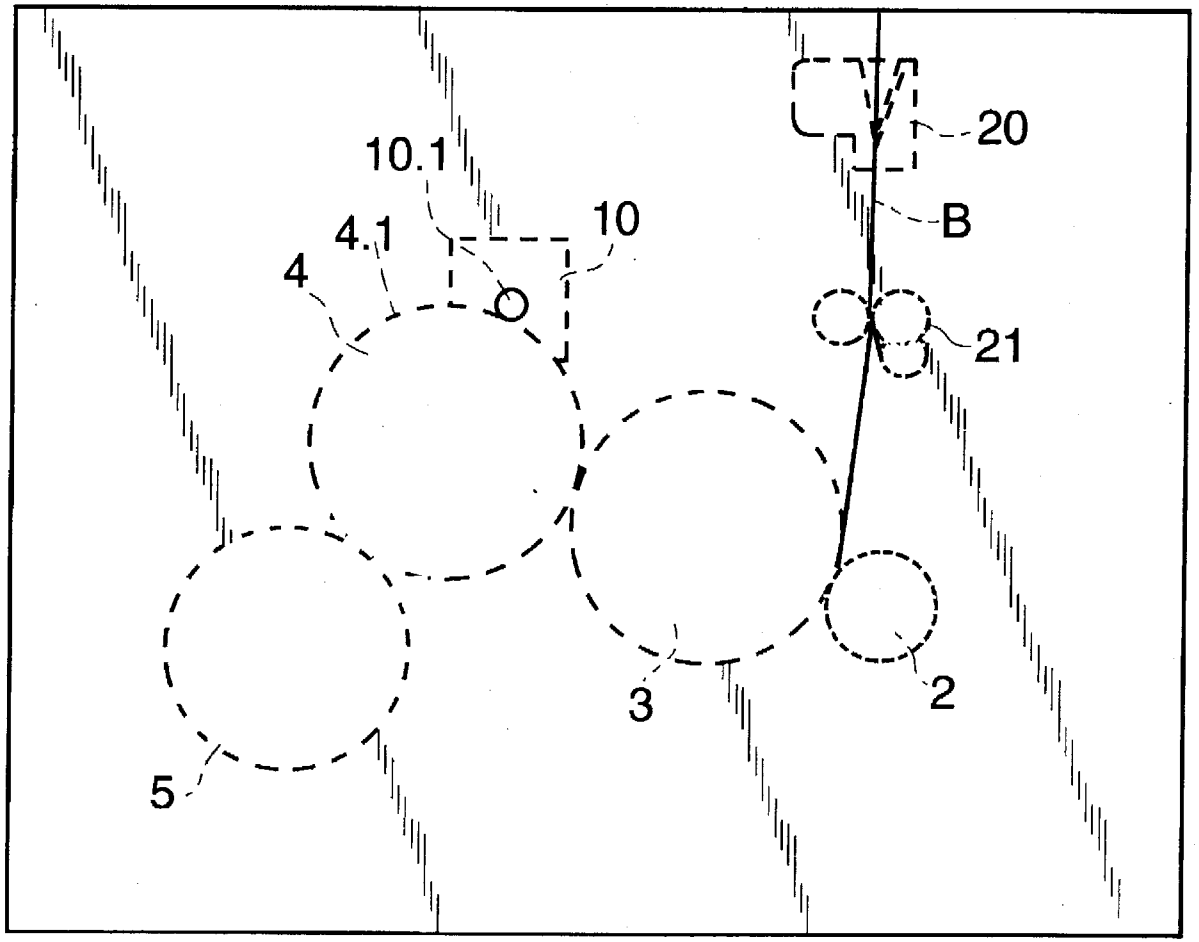
FIG. 2 is an individually driven folder of the present invention.

In FIG. 2, a printed web B runs through a web-severing device 20. A draw roller pair 21 is arranged behind the web serving device 20. The web then passes to a collecting cylinder 3 with a cutting cylinder 2. It is cut there transversely, and it is subsequently transferred from the collecting cylinder 3 to the folding jaw cylinder 4 and from there to a spider wheel 5 acting as a delivery means. It is also possible to provide a conveying means circulating endlessly between two rollers with grippers for the folded printed copies instead of the spider wheel 5.

In the exemplary embodiment shown, the folding jaw cylinder 4 is driven directly by a drive motor 10. The mechanical coupling between the drive motor 10 and the folding jaw cylinder 4 is formed Via a motor-side pinion 10.1 and a cylinder-side spur gear 4.1.

Figure 3:
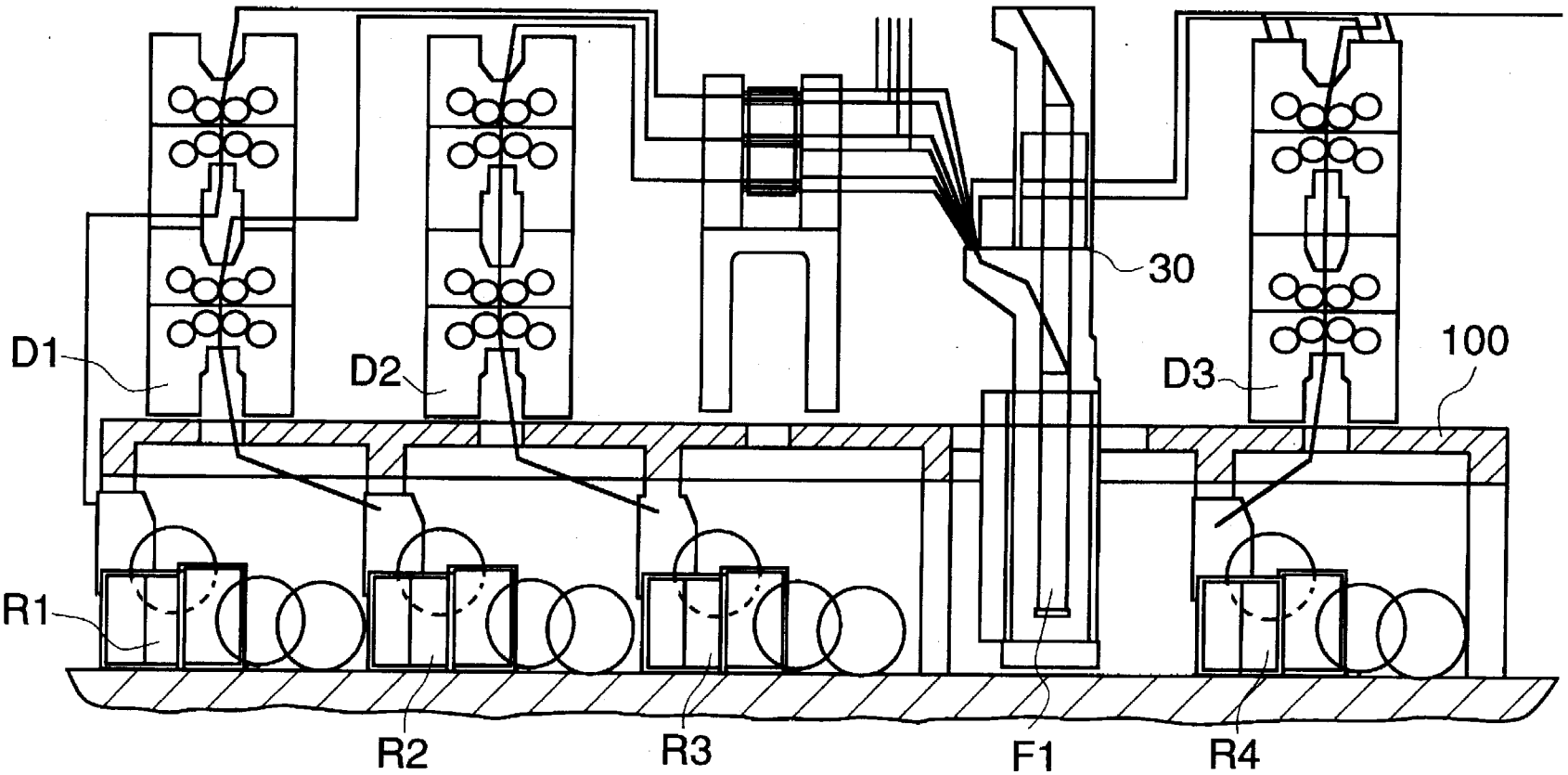
FIG. 3 is a first arrangement variant for two folders, wherein one folder is arranged in a press cellar.
Figure 4:
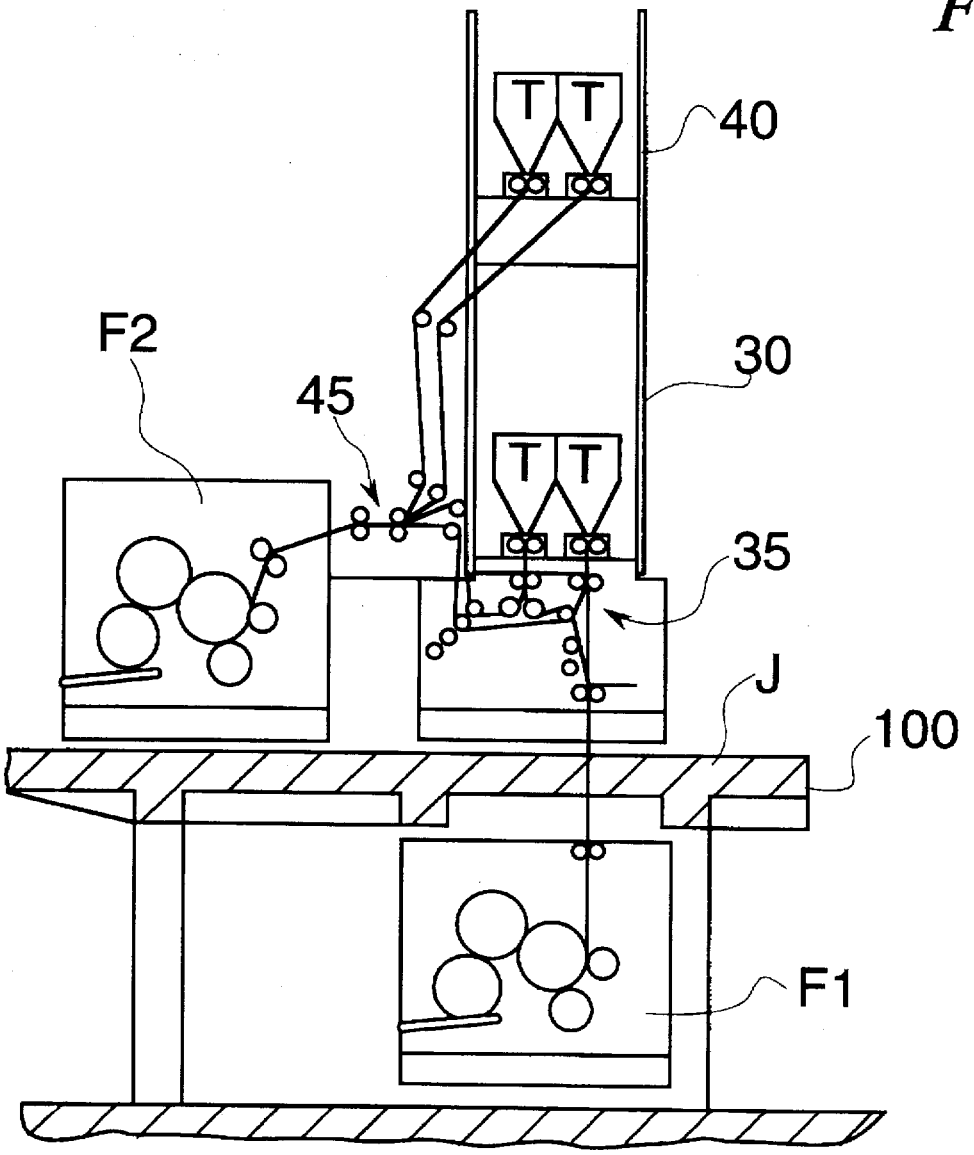
FIG. 4 is a more detailed representation of the arrangement variant according to FIG. 3.

FIG. 3 shows a printing press, which is an example of the gain in flexibility in terms of the possibilities for installation of the individually driven folders. In this exemplary embodiment, a folder unit F1 is installed in the press cellar in the same plane as the reel changers R1, R2, R3 and R4, while printing units D1, D2 and D3 are located in a superjacent shop plane 100, aligned one behind the other. As shown in FIG. 4, a folding structure 30, which has at least one hopper in one or more planes, is arranged above the folder F1 and is mounted on the folder. The folding superstructure parts 30, 40 are arranged between the two printing units D2 and D3, so that the printed webs enter from two sides.

A second folder may be provided next to this first folder F1. The second folder is preferably also arranged in the reel changer plane or in the shop plane 100, preferably approximately aligned with the lower folding superstructure 30.

The printed webs may be fed optionally to one of the folders. Only the folder F1 located in the press cellar is in operation in the example shown in FIG. 3. If two folders are provided, some of the printed webs conveyed farther behind the printing units may be fed to the folding structure, which is indicated by broken lines as an example. The printed webs, folded lengthwise, then enter the second folder from the upper hopper of the folding structure 30, while the printed webs folded in the lower hopper of the folding structure 30 continue to be fed to the first folder F1.

FIG. 4 shows the arrangement of the second folder F2 in the shop plane 100. The first folder F1 is again placed in the press cellar, in the same plane as the reel changers, not shown in FIG. 4, while the second folder F2 is arranged next to the press, delivering to one side of the press. The folding superstructure 30 and 40 with two double hoppers T arranged vertically one on top of another is mounted in a yoke J. The yoke J itself is mounted in FIG. 4 in the shop plane 100 or on the press table above the first folder F1 and independently therefrom. Part 35 of the folding structure with deflecting and draw rollers is arranged between the first folder F1 and its part 30 of the folding superstructure in the same yoke J. The corresponding folding structure part 45 for the second folder F2 is located between the yoke J and the second folder F2. The folding superstructure part 40 for this second folder F2 is accommodated in the upper part of the yoke J.

Both the mounting and the drive of the folding superstructure 30 in the example according to FIG. 4 are mechanically independent from the drive and the mounting of the folders. This is also true of their folding structure 35, 45.

Figure 5:
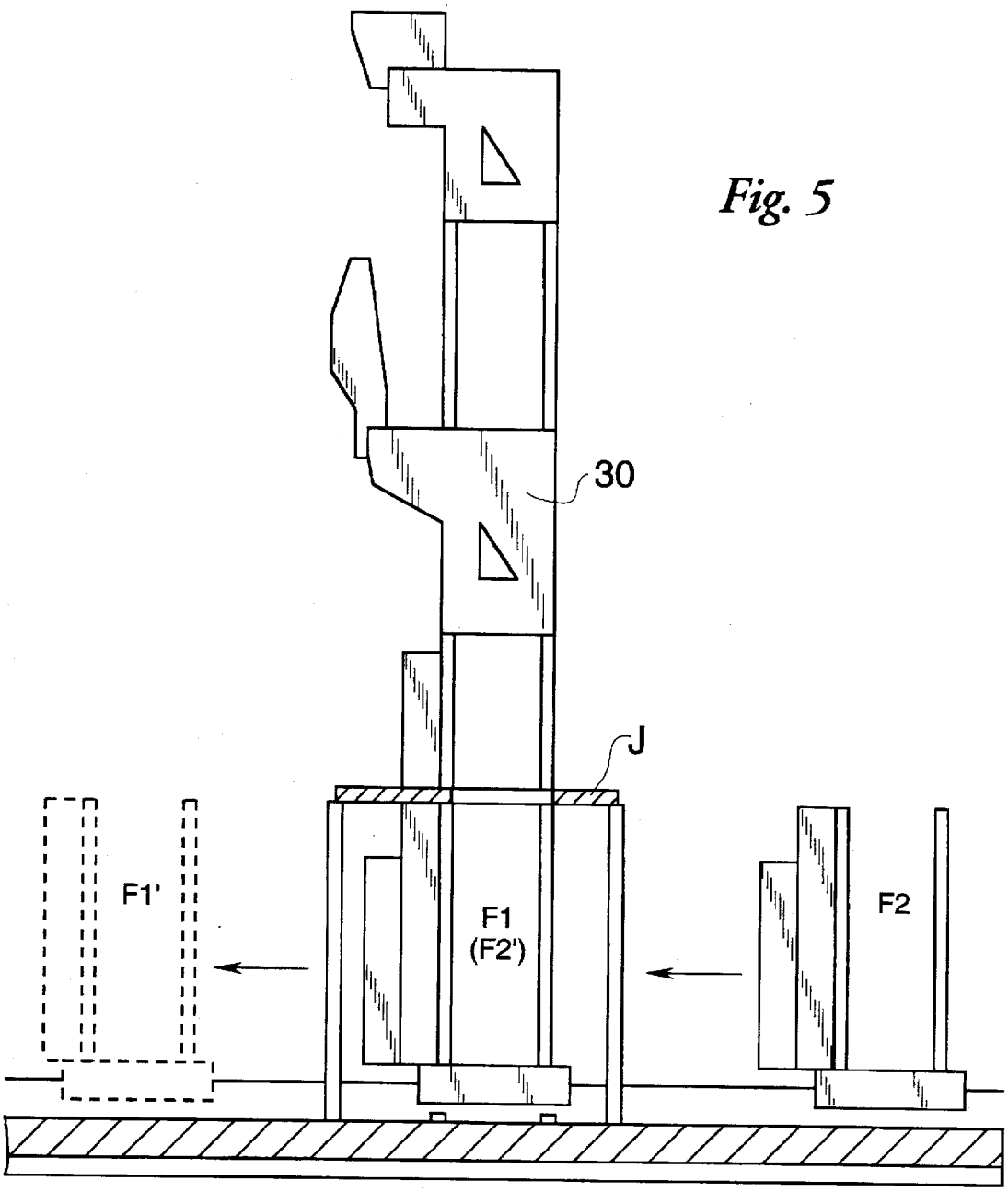
FIG. 5 is a second arrangement variant, in which a plurality of folders are arranged next to each other in the press cellar.

FIG. 5 shows two folders F1, F2 arranged in one plane, on the press table or in the press cellar. Only the first folder F1 is in operation, while the second folder is used as a back-up.

The printed web or webs is/are again fed to the folder F1 via a folding structure 30 mounted on a yoke J. The yoke J is mounted independently from the folders F1 and F2, which makes it possible to replace the first folder F1 with the back-up folder F2. The replacement of the folder F1 with the back-up folder F2 can be carded out in an especially simple manner if the two folders are traveling, or movable, folders (F1→F1' and F2→F2').

Figure 6:
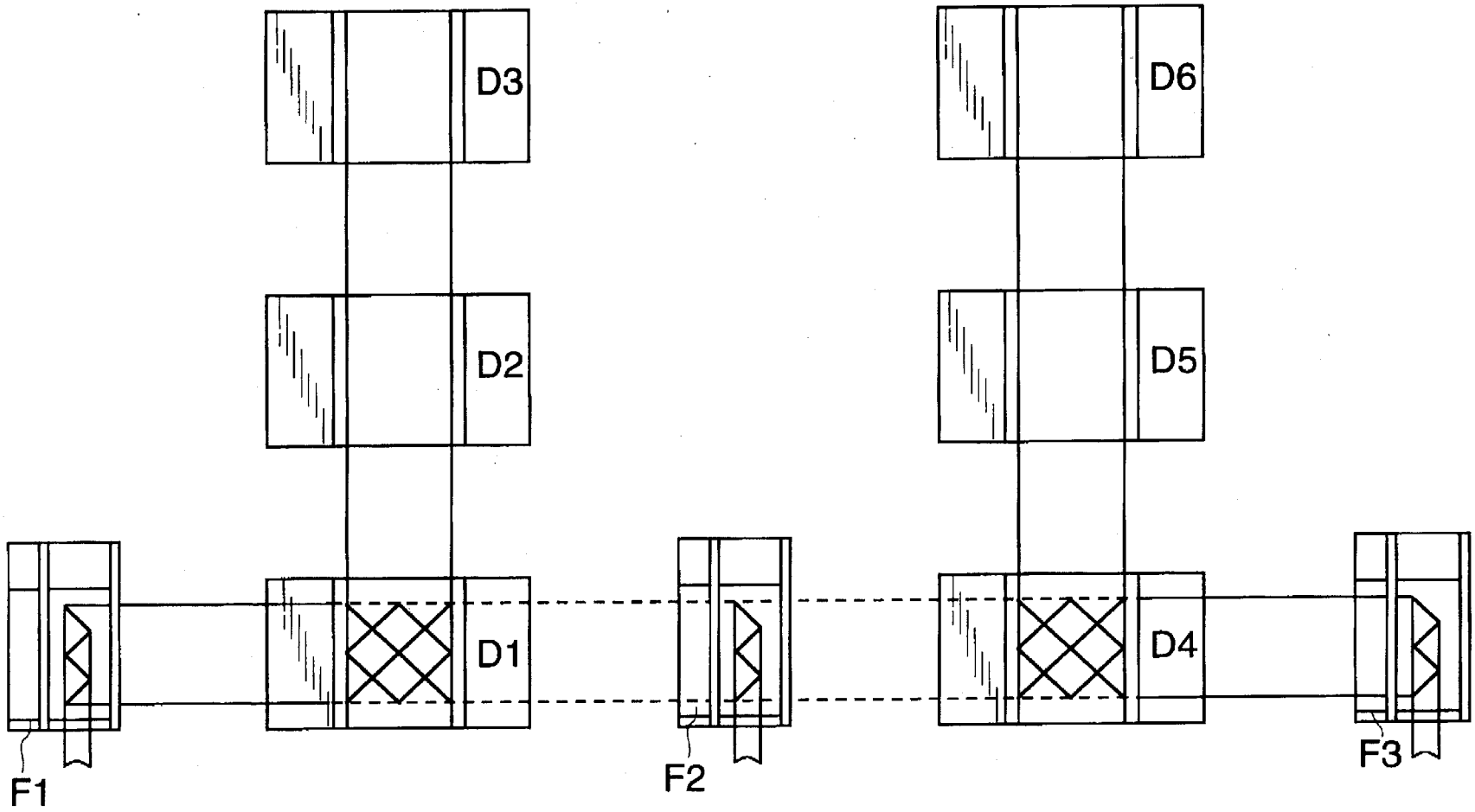
FIG. 6 is a third arrangement variant for a plurality of folders, which are arranged on one side each to the left and right of a printing unit.

FIG. 6 shows another example demonstrating the flexibility of the possible configurations of the printing press. The printing press has six printing units D1 through D6, of which three printing units each are arranged, when viewed in the direction of delivery of the web, one behind the other, and two such rows of three printing units each are mounted next to each other. Folders F1, F2 and F3 are placed to the left and right of the respective last printing unit D1 and D4 of the two rows of three printing units each such that one of the folders, F2, is arranged between the last two printing units D1 and D4, and so that printed webs can be fed from these two printing units to the centrally arranged folder F2, which is a common folder in this case. The other two folders F1, F2 and F3 are arranged on the still free outsides of each of the printing units D1 and D4.

An associated folder structure 30 with a folding hopper, or folding hoppers, is located above each of the folders F1, F2 and F3, while the necessary deflecting rollers and turner bars for feeding in the printed webs are arranged above the last two printing units D1 and D4 standing next to the folders F1 and F3. The folded printed copies may be delivered uniformly in the longitudinal direction of the press. However, they may also be delivered to the sides in the case of the two outer folders F1 and F3, which again demonstrates the flexibility of the solution according to the present invention.

While specific embodiments of the invention have been shown and described in detail to illustrate the application of the principles of the invention, it will be understood that the invention may be embodied otherwise without departing from such principles.

What is claimed is:

1. A rotary panting press comprising:

a plurality of panting units;

a plurality, of folder units associated with said plurality of printing units, each of said plurality of folder units including a cutting cylinder and a folding jaw cylinder, said each folder unit also including a separate drive motor for independently mechanically driving a respective said folder unit separately from said plurality of panting units, said each folder unit being installable and registerable independently from said plurality of printing units.

2. A rotary printing press in accordance with claim 1, wherein:

said plurality of folder units includes a first folder and a second folder, said first folder and said second folder are positioned in a shop plane and aligned one behind another in a longitudinal direction of said plurality of said panting units as a left folder design and as a right folder design in one of a back-to-back arrangement and on a same side of the panting press as a double folder.

3. A rotary printing press in accordance with claim 1, wherein:

said plurality of folder units includes a first folder and a second folder, said first folder is positioned in a shop plane, and said second folder is positioned in a reel changer plane which is vertically offset from said first folder.

4. A rotary printing press in accordance with claim 1, wherein:

said plurality of folder units includes a first folder and a second folder, said first folder and said second folder are positioned in a shop plane.

5. A rotary printing press in accordance with claim 1, wherein:

said each of said plurality of folder units are designed to be repetitively movable with respect to said plurality of printing units.

6. A rotary printing press in accordance with claim 1, further comprising:

a folding structure associated with said plurality of printing units and folder units, said folding structure being driven mechanically independently from said plurality of printing units and said plurality of folder units.

7. A rotary printing press in accordance with claim 1, further comprising:

a folding structure associated with said plurality of printing units and folder units, said folding structure being mounted independently and upstream from said folder units, said folding structure being mounted in one of a plane of the press and above the plane of the press.

8. A rotary printing press in accordance with claim 6, wherein:

said folding structure operates with more than one of said plurality of folder units.

9. A rotary printing press in accordance with claim 1, wherein:

each of said printing units includes a plurality of cylinder pairs, each of said cylinder pairs including one printing cylinder and one counterpressure cylinder, said each cylinder pair being driven mechanically independently from other said cylinder pairs of said each printing unit, each of said printing cylinders being driven mechanically independently from a respective counterpressure cylinder in a respective said cylinder pair and other counterpressure cylinders associated with said printing cylinder.

10. A rotary printing press in accordance with claim 1, wherein:

said drive motor drives said folding jaw cylinder via a mechanical coupling.

11. A rotary printing press in accordance with claim 1, wherein:

said drive motor drives said cutting cylinder via a mechanical coupling.

12. A rotary printing press in accordance with claim 1, wherein:

said each folder unit includes a collecting cylinder, and said drive motor drives said collecting cylinder via a mechanical coupling.

13. A rotary printing press in accordance with claim 1, wherein:

said each folder unit includes a delivery means, and said drive motor drives a gear in a drive line between said cutting cylinder and said delivery means.

14. A rotary printing press in accordance with claim 1, wherein:

said each folder unit includes a collecting cylinder and a delivery means;

said drive motor drives said cutting cylinder, said collecting cylinder, said delivery means and said folding jaw cylinder by a mechanical coupling, said mechanical coupling including a pinion on said drive motor and a drive line connecting said cutting cylinder, said collecting cylinder, said delivery means and said folding jaw cylinder, said pinion driving one of an intermediate gear in said drive line and a gear directly connected to one of said cutting cylinder, said collecting cylinder, said delivery means and said folding jaw cylinder.

15. A rotary printing press in accordance with claim 1, wherein:

said each folder unit includes a collecting cylinder and a delivery means;

said drive motor directly drives one of said cutting cylinder, said collecting cylinder, said delivery means and said folding jaw cylinder.

16. A rotary printing press in accordance with claim 1, wherein:

said each folder unit includes a delivery means;

said drive motor drives said cutting cylinder, said delivery means and said folding jaw cylinder by a mechanical coupling, said mechanical coupling including a drive line connecting said cutting cylinder, said delivery means and a gear between said cutting cylinder and said delivery means, said drive motor being connected to said mechanical coupling by a toothed belt.

* * * * *

US005676056B1

REEXAMINATION CERTIFICATE (4113rd)

United States Patent [19]

Stein et al.

[11] B1 5,676,056

[45] Certificate Issued Jul. 11, 2000

[54] ROTARY PRINTING PRESS WITH A FREELY MOUNTABLE FOLDER

[75] Inventors: Götz Stein, Bolligen; Hans Ulrich Siegenthaler, Brenzikofen, both of Switzerland

[73] Assignee: Maschinenfabrik WIFAG, Bern, Switzerland

Reexamination Requests:
No. 90/005,166, Nov. 18, 1998
No. 90/005,192, Dec. 16, 1998

Reexamination Certificate for:

| | |
|---|---|
| Patent No.: | **5,676,056** |
| Issued: | **Oct. 14, 1997** |
| Appl. No.: | **08/642,465** |
| Filed: | **May 3, 1996** |

[30] Foreign Application Priority Data

May 4, 1995 [DE] Germany ..... 195 16 445

[51] Int. Cl.[7] ..... B41F 13/56

[52] U.S. Cl. ..... 101/226; 101/248; 270/6; 270/21.1; 493/359; 493/405; 493/410

[58] Field of Search ..... 101/216, 219, 101/224, 225, 226, 227, 228, 248; 493/405, 411, 416, 442, 356, 361, 362, 357, 359, 324, 424; 270/52.05, 6, 21.1

[56] References Cited

U.S. PATENT DOCUMENTS

| | | |
|---|---|---|
| 5,309,834 | 5/1994 | Koch . |
| 5,341,735 | 8/1994 | Hajek . |
| 5,405,127 | 4/1995 | Welborn . |

FOREIGN PATENT DOCUMENTS

| | | |
|---|---|---|
| 0 567 741 A1 | 11/1993 | European Pat. Off. . |
| 06 99524A2 | 8/1995 | European Pat. Off. . |
| 2 046 131 | 3/1972 | Germany . |
| 26 14 665 A1 | 10/1976 | Germany . |
| 41 27 321 A1 | 2/1993 | Germany . |
| 2 149 149 | 6/1985 | United Kingdom . |

OTHER PUBLICATIONS

Boris Fuchs, Color Management Systems . . . , *Deutscher Drucker*, Nos. 14–15, Apr. 13, 1995 pp. w40–w53.

Boris Fuchs Rotary Printing Press Drive . . . *Zeitungstechnik*, Dec. 1991, pp. 78–80.

*Primary Examiner*—Eugene Eickholt

[57] ABSTRACT

In a rotary printing press with at least one folder, which comprises at least one cutting cylinder and one folding jaw cylinder, each folder is driven, due to being equipped with at least one separate drive motor, mechanically independently at least from the printing units of the printing press, and can be installed and registered independently therefrom.

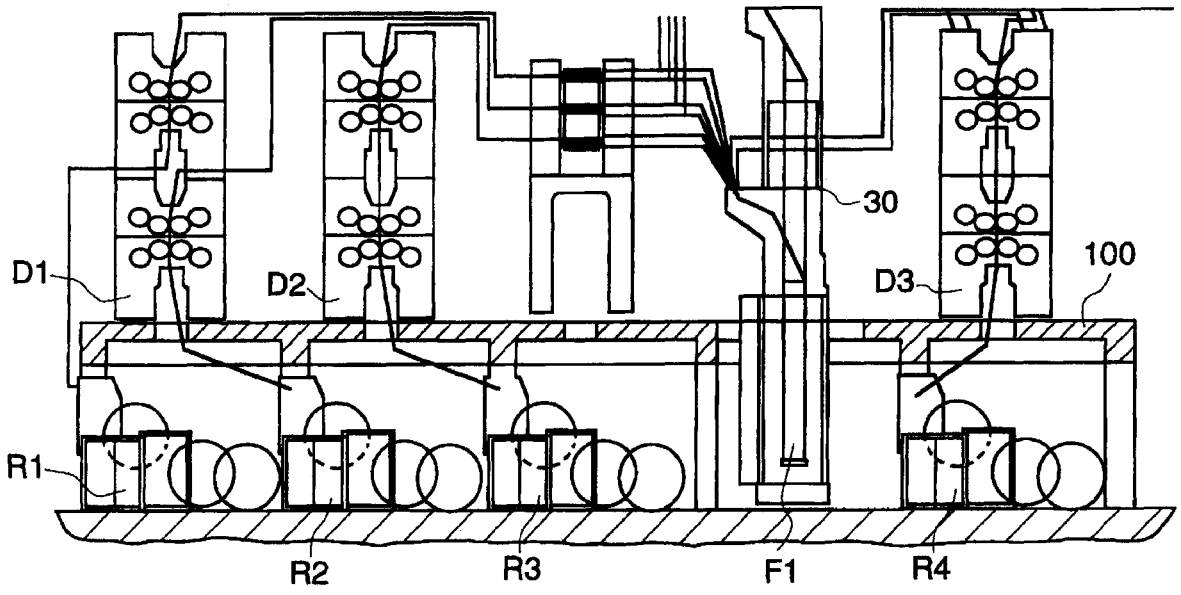

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claim 1 is determined to be patentable as amended.

Claims 2, and 4–16, dependent on an amended claim, are determined to be patentable.

1. A rotary printing press comprising:

a plurality of printing units;

a plurality of folder units associated with said plurality of printing units, each of said plurality of folder units including a cutting cylinder and a folding jaw cylinder, said each folder unit also including a separate drive motor for independently mechanically driving a respective said folder unit separately from said plurality of printing units, said each folder unit being installable and registerable independently from said plurality of printing units, *said plurality of folder units include a first folder and a second folder, said first folder is positioned in a shop plane, and said second folder is positioned in a reel changer plane which is vertically offset from said first folder*.

* * * * *